United States Patent [19]

Haller

[11] 4,167,211

[45] Sep. 11, 1979

[54] INTERLOCKING SPACER MEMBERS FOR COILED TUBE ASSEMBLY

[75] Inventor: Dieter Haller, Garching, Fed. Rep. of Germany

[73] Assignee: Linde Aktiengesellschaft, Wiesbaden, Fed. Rep. of Germany

[21] Appl. No.: 781,487

[22] Filed: Mar. 25, 1977

[30] Foreign Application Priority Data

Mar. 31, 1976 [DE] Fed. Rep. of Germany ..... 2613745

[51] Int. Cl.[2] ..... F28D 7/00; F28F 9/00

[52] U.S. Cl. ..... 165/78; 165/162; 165/163; 165/172; 248/68 CB

[58] Field of Search ..... 165/162, 163, 171, 172, 165/178, 78, 82; 122/510; 248/68 R, 68 CB, 224.1, 224.2; 52/590

[56] References Cited

U.S. PATENT DOCUMENTS

| | | | |
|---|---|---|---|
| 3,286,767 | 11/1966 | Evans | 165/163 |
| 3,442,763 | 5/1969 | Chetter et al. | 165/162 |
| 3,509,939 | 5/1970 | Weber | 165/163 |
| 3,545,534 | 12/1970 | Coles | 165/163 |
| 3,595,309 | 7/1971 | Hawkins | 165/162 |
| 3,677,339 | 7/1972 | Perrin et al. | 165/178 |
| 3,701,381 | 10/1972 | Watts | 165/82 |
| 3,956,862 | 5/1976 | Alexandre | 52/590 |
| 4,036,289 | 7/1977 | Cheng et al. | 165/162 |

*Primary Examiner*—Carlton R. Croyle
*Assistant Examiner*—Thomas I. Ross
*Attorney, Agent, or Firm*—Karl F. Ross

[57] ABSTRACT

A heat exchanger of the type in which multiple layers of helically coiled tubes surround a core tube, has spacers between the layers which are constituted by elongated bodies provided with seats receiving successive tubes of each layer and having dovetail formations enabling the bodies of each layer to be connected to those of the adjoining layers. The bodies thus act as spacers for the successive turns in each layer and for the successive layers and retain the turns specifically at the ends of the coils to facilitate positioning thereof with respect to the core tube and/or the housing.

4 Claims, 4 Drawing Figures

FIG. 1
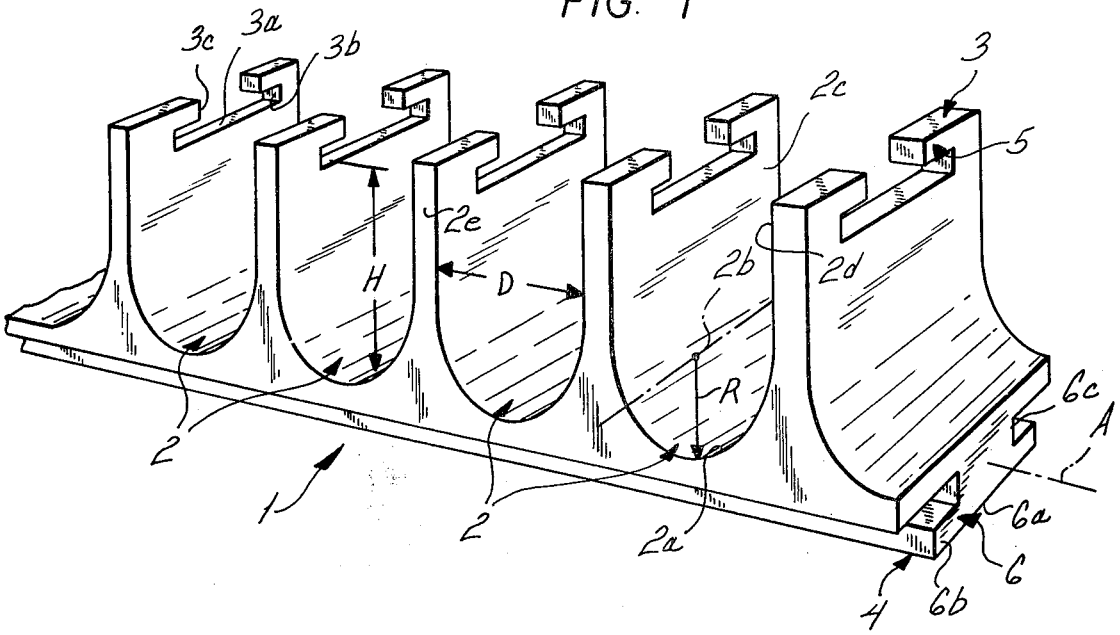
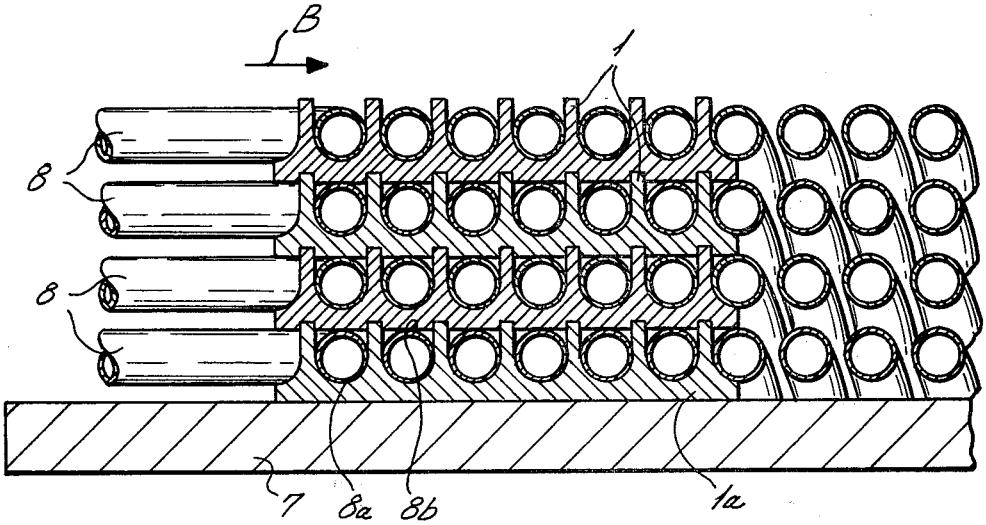
FIG. 2

INTERLOCKING SPACER MEMBERS FOR COILED TUBE ASSEMBLY

FIELD OF THE INVENTION

The present invention relates to a heat exchanger of the type in which a plurality of generally coaxial layers of helically coiled tubes are disposed about a core tube, each layer being made of a multiplicity of heat exchanger tubes wound helically around the core tube. More specifically, the invention relates to a clamping body for use in a heat exchanger of this type.

BACKGROUND OF THE INVENTION

A heat exchanger which comprises an outer shell, a core disposed centrally in this shell or housing, means for admitting a fluid to the shell and drawing a fluid from the shell, and a tube bundle disposed around the core within the shell and traversed by one or more of the fluids, is commonly in use in low-temperature technology for the direct heat exchange of two or more fluids.

Of particular interest of late is a system of this type in which the tube bundle consists of a multiplicity of coaxial layers of heat-exchanger tubes, each layer comprising a multiplicity of helically coiled tubes, i.e. a plurality of coils. At the ends of these layers, the tubes can extend axially from the respective coils and pass through the housing or into a manifold within the housing whereby a fluid is fed to or withdrawn from the respective layers.

In order to hold the tubes of successive coaxial layers in the requisite spaced relationship to facilitate uniform passage of the surrounding fluid through the housing and between the tubes, spacers are generally employed. Furthermore, it is necessary to retain the tubes of at least the initial and terminal turns of each layer in a fixed relationship to one another, to the core tube and to the housing. This can also be accomplished by clamping members which have a comb-like configuration into the recesses, notches or cavities of which the tubes of the layer are placed and to which the tubes are welded to retain each tube in a fixed location with respect to the clamping member or spacer.

The distance between adjacent tubes within the layer and between layers is relatively small and frequently the tubes are extremely thin so that welding to regain the tubes in position poses problems of possible penetration of the tube wall, insufficient anchoring of the tube turn or the like. It will be understood that massive welds which would insure firm attachment of the tube coils are precluded by the nature of the tube while, on the other hand, an insufficient weld attachment will render the spacers, clamping members and the like, ineffective.

Should the tube wall burn through, it is necessary to either remove the entire coil or seal off the coil (i.e. forming a blind coil) which removes the same from participation in the heat exchange operation.

Among other disadvantages of inadequate welds is the tendency for the turns or coils to develop nonuniform diameters and thus interfere with the insertion of the tube bundle in the heat exchanger's shell or housing, removal of the tube bundle therefrom in the event repair is necessary, etc.

Thus the art has long been confronted by the problem of fixing, at least at the terminal turns, multilayer helically-coiled heat-exchanger tubes with respect to one another, i.e. between layers and between turns of a layer, retaining these tubes in precise positions without welding, and maintaining uniform cylindrical configurations of the various layers of the tube bundle. A successful solution to the problem offers simplification in the construction of such heat exchangers, increased efficiency by reducing the number of turns or coils which may remain in the unit but are ineffective, and reduced labor expenditure in constructing such heat exchangers.

OBJECTS OF THE INVENTION

It is, therefore, the principal object of the present invention to provide a heat exchanger of the character described in which the aforementioned disadvantages are obviated.

It is another object of the invention to provide a heat exchanger of the type in which a plurality of coaxial layers of helically-coiled heat exchanger tubes can be fixed relative to one another without the need for welding.

Still another object of the invention is to provide an improved spacer body which, on the one hand, facilitates the construction of a tube-layer heat exchanger and, on the other hand, permits the resulting heat exchanger structure to be more easily fabricated.

Yet another object of the invention is to simplify the positioning, fixing and coiling of heat-exchanger tubes for a multilayer tube-coil heat exchanger.

SUMMARY OF THE INVENTION

These objects and others which will become apparent hereinafter are attained, in accordance with the present invention, which involves the use of a clamping body provided with seats for successive turns of the tubes of each layer and provided on its opposite sides with formations connectible to the complementary formations of another such body of the next layer for securing the two layers in a fixed spaced relationship. According to an important feature of the invention, the formations are configured such that relative longitudinal movement of the two bodies locks the turns of the first layer in the respective seats or recesses.

More particularly, the invention provides at the upper ends of a tube-coil heat exchanger, clamping assemblies of the type described and which serve to fix the turns of the coils together in the regions in which the lead-in and lead-out portions of the tubes extend away from the respective coils.

The mating longitudinally engageable formations are preferably dovetail-like members which extend parallel to the longitudinal axis of the heat exchanger.

According to a feature of the invention, a first elongated clamping body according to the invention is mounted initially on the core tube prior to the coiling of the first tube layer thereon. This body can be welded to the core tube or, if desired, anchored thereto by a dovetail formation matingly coupling the body with the core tube. The first layer can then be applied around the core tube with the turns thereof laid into the nests or concavities of the first body, whereupon a second body, radially outwardly of the first, is fitted to the latter with another set of mating dovetail formations to allow the second layer of tube coils to be wound in place. The second clamping body can be applied to the first without damaging the turns of the first layer and the clamping bodies can be form-fittingly connected against radial movement to precisely space the successive layers. However, it is convenient to provide the mating formations so that relative displacement of the two bodies is possible for reasons which will be apparent hereinafter. The terms "radial" and "axial" are used herein as they refer to the core tube, i.e. radially spaced implies spaced along a radius outwardly from the axis of the core tubes, while axial displacement implies displacement parallel to the axis of the core tube. The spacing between the individual turns of each layer is maintained precisely and is determined exclusively by the center-to-center spacing of the recesses, notches or nests in which these turns are received. The space between layers is determined by the radial center-to-center distance of the nests of two such clamping members coupled together by their dovetail formations.

If the entire tube bundle is anchored, at least at its axial ends, by coupling the tubes together with such clamping bodies, the diameter of the tube bundle in the region of the first and last turns does not vary from that intermediate these turns and the tube assembly can be radially inserted into and removed from a housing or shell.

According to a feature of the invention, the mating formations constituting the dovetail-like guide elements are provided with a T profile.

When the heat exchanger consists of helically coiled tubes as described above, the tube nests, notches or recesses have their axes inclined to the longitudinal axis of the clamping body such that the smallest angle included between them is 90° or less, corresponding to the pitch of the helix. The longitudinal axis of the clamping body can then lie strictly parallel with the axis of the coil tube or can coincide with a generatrix thereof.

BRIEF DESCRIPTION OF THE DRAWING

The above and other objects, features and advantages of the present invention will now become more readily apparent from the following description, reference being made to the accompanying drawing in which:

FIG. 1 is a perspective view of a clamping body according to the present invention;

FIG. 2 is an axial cross-sectional view through a portion of a heat exchanger using four such clamping bodies to anchor four tube layers;

SPECIFIC DESCRIPTION

In FIG. 1 I have shown a clamping body 1 which is cast unitarily, i.e. in one piece, from a thermally conductive metal, e.g. aluminum, and is provided with a multiplicity of transverse grooves 2, four of which have been illustrated. The transverse grooves 2 each have an arcuate floor or bottom 2*a* with a center of curvature lying along an axis 2*b* and hence of generally cylindrical configuration. Above the axis 2*b*, the grooves are provided with parallel flanks 2*c* and 2*d* which lie in planes perpendicular to the axial plane A of the bodies. The walls 2*c* and 2*d* are separated by a distance D corresponding substantially to the outer diameter of the tubes to be received therein, the diameter D corresponding substantially to 2R where R is the radius of curvature of the cylindrical floor 2*a* of each group. The height H from the floor to the bottom edge 3*a* of the female dovetail formations 3 at the top of body 1 is slightly less than D so that the tube can be clamped by slight deformation of the groove.

Figure 4:
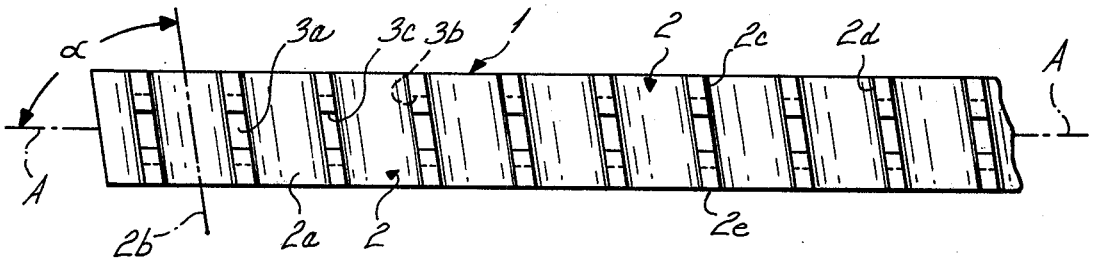
FIG. 4 is a plan view, drawn to a smaller scale, of the clamping body of FIG. 1.

As can be seen in FIG. 4, the smallest angle $\alpha$ between axis 2*b* of each groove 2 and the longitudinal axis A of the body 1 is between 70° and 90° corresponding to the pitch angle of the helically coiled tube.

The number of grooves 2 of each body 1 can be chosen in accordance with the particular heat exchanger requirement although it has been found that a preferred number of grooves is fifteen.

The upper and lower sides 3 and 4 of the body 1 are provided with mating dovetail-like formations generally represented at 5 and 6 which permit the bodies 1 to be joined together in the axial direction but prevent radial displacement of one of the bodies relative to the other. Advantageously, the formations 5 and 6 are of T cross-section.

As can be seen in FIG. 1, each of the walls 2*e* between two grooves 2 is provided with an inverted-T-shaped window including an elongated slot 3*b* whose bottom edge 3*a* has already been described, and a small opening 3*c* communicating with the slod 3*b*.

Correspondingly, the T-section rail which constitutes the lower formation 6 has a head 6*b* complementary to slot 3*b*, and a shank 6*c* complementary to slot 3*c*. The underside 6*a* of this rail is adapted to press against the turns 8*a* of a tube coil at 8*b* as shown in FIG. 2.

As can be seen from FIG. 2, the heat exchanger can comprise a core tube to which the body 1*a* (corresponding to the body 1 of FIG. 1 but omitting the rail 6) can be welded directly.

The two bodies 1 can be applied by axially shifting them into place in the direction of the arrow B in FIG. 2 with the rail 6 passing through the window 3*b*, 3*c* of the previously emplaced body 1*a* or 1.

Figure 3:
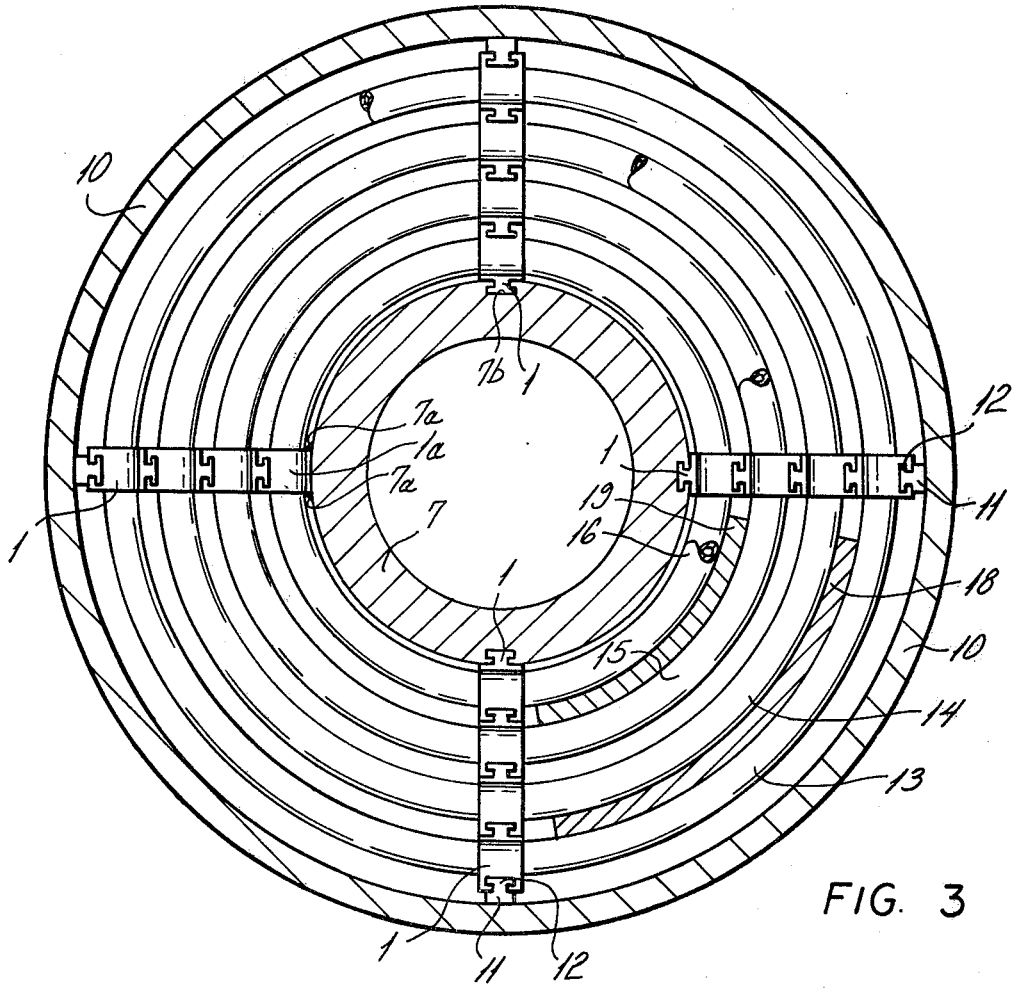
FIG. 3 is a cross-sectional view taken in a plane perpendicular to that of FIG. 2 and illustrating another aspect of the invention.

In the fabrication of a heat exchanger in accordance with the present invention, a plurality of such bodies 1 or 1*a* can be mounted fixedly on the periphery of a coil tube 7 (see FIG. 3). In this Figure, the coil tube 7 has body 1*a* welded thereto at 7*a* but is formed with a plurality of T-section grooves 7*b* in which the bodies 1 are fitted. The tubes of the first layer 16 are then coiled into the grooves 2 of these bodies progressively and as each groove is filled with a turn of the tube, the next clamping body 1 is advanced axially (arrow B) to cover this groove and retain the turn in place. The tube is then laid into the next groove and the outer clamping body 1 is advanced until the tube coil for the inner three layers shown in FIG. 2 is formed. When the outer tube coil (FIG. 2 or FIG. 3) is in place as represented at 13 in FIG. 3, bars 11 with dovetail-like formation can be inserted into the outermost clamping body 1 to retain the assembly against uncoiling. In FIG. 3, the intermediate tube layers are represented at 14 and 15.

Members 11 form axially extending runners which facilitate insertion of the tube assembly into the shell or housing 10 of the heat exchanger. It may also be provided to facilitate sealing around the tube bundle and, if desired, one or more sheet metal strips can be introduced between the individual layers or can be connected to runners 11. When strips are inserted between the layers as has been illustrated at 18 and 19 they can have a thickness corresponding to the radial spacing of the coaxial layers.

I claim:

1. A heat exchanger comprising a coil assembly having a plurality of coaxial layers of helically coiled tubes, a respective spacer body for each of said layers, said bodies being all identical and constituting the sole means for holding said coils in spaced apart relation said bodies each being elongated and formed with a multiplicity of recesses receiving respective turns of the respective layer and mating formations on opposite sides of each body enabling the weld-free interconnection of said bodies to space said layers apart by relative longitudinal displacement of two adjacent bodies, each of said bodies being formed along an underside with a continuous T-section rail constituting one of said formations, each body being provided between each two of the respective recesses with a wall lying in a plane perpendicular to the rail and having a free end remote therefrom, all of said free ends being formed with T-shaped windows which are aligned with one another parallel to the respective rail for accommodating the rail of an adjacent body, said bodies being connected to one another solely by the fitting of a rail of one body into the windows of another.

2. The heat exchanger defined in claim 1 wherein each of said recesses is a groove extending transversely to the longitudinal axis of the body, said grooves each having axes inclined to the axis of said body such that the small angle included between each groove axis and longitudinal axis of said body is between 70° and 90°.

3. The heat exchanger defined in claim 2 wherein said body of the outermost layer receives a bar closing its grooves and forming a runner enabling insertion of said layers in a housing of the heat exchanger.

4. The heat exchanger defined in claim 3, further comprising a core tube, said layers being disposed around said core tube, the body of the innermost layer being attached to said core tube, said body of said innermost layer being welded to said core tube, for each of said layers a plurality of such bodies being angularly spaced around said core tube.

* * * * *